US009322214B2

(12) United States Patent
Bohlen et al.

(10) Patent No.: US 9,322,214 B2
(45) Date of Patent: Apr. 26, 2016

(54) COVERING FOR AN ARCHITECTURAL OPENING

(75) Inventors: Jorg Bohlen, Langen (DE); Lars Koop, Bremerhaven (DE)

(73) Assignee: Hunter Douglas Industries B.V., Rotterdam (NL)

( * ) Notice: Subject to any disclaimer, the term of this patent is extended or adjusted under 35 U.S.C. 154(b) by 935 days.

(21) Appl. No.: 12/696,650

(22) Filed: Jan. 29, 2010

(65) Prior Publication Data

US 2010/0212843 A1 Aug. 26, 2010

(30) Foreign Application Priority Data

Feb. 9, 2009 (EP) ..... 09001777

(51) Int. Cl.
*E06B 9/56* (2006.01)
*E06B 9/88* (2006.01)
*E06B 9/68* (2006.01)

(52) U.S. Cl.
CPC ..... *E06B 9/88* (2013.01); *E06B 2009/6881* (2013.01)

(58) Field of Classification Search
CPC ..... E06B 2009/6881; E06B 9/80; E06B 9/88; E06B 9/08; E06B 9/17
USPC ..... 160/193, 291, 292, 298, 299, 293.1, 160/294, 295, 322, 343; 267/154, 155
See application file for complete search history.

(56) References Cited

U.S. PATENT DOCUMENTS

| | | | | |
|---|---|---|---|---|
| 1,786,512 | A * | 12/1930 | Whitworth | 160/295 |
| 2,020,595 | A | 11/1935 | Weber | |
| 2,514,394 | A * | 7/1950 | Irving | 464/57 |
| 4,482,137 | A * | 11/1984 | Gavagan et al. | 267/157 |
| 6,685,592 | B2 | 2/2004 | Fraczek et al. | |
| 6,782,938 | B2 * | 8/2004 | Colson et al. | 160/121.1 |
| 6,955,207 | B2 * | 10/2005 | Minder | 160/298 |
| 7,195,052 | B2 | 3/2007 | Nien et al. | |
| 7,234,503 | B2 * | 6/2007 | Kwak | 160/296 |
| 7,549,458 | B2 * | 6/2009 | Kwak | 160/319 |
| 2004/0154759 | A1 * | 8/2004 | Minder | 160/298 |
| 2012/0061035 | A1 * | 3/2012 | Hsieh | 160/293.1 |

FOREIGN PATENT DOCUMENTS

EP 0 210 381 A2 2/1987

* cited by examiner

*Primary Examiner* — Syed A Islam
*Assistant Examiner* — Jeremy Ramsey
(74) *Attorney, Agent, or Firm* — Dorsey & Whitney LLP

(57) ABSTRACT

The present invention relates to end stops for use in retractable coverings for architectural openings where the end stops have impact-absorbing means which are bi-directionally cushioning. The end stop will remain at a dedicated position even after being impacted.

18 Claims, 5 Drawing Sheets

COVERING FOR AN ARCHITECTURAL OPENING

CROSS REFERENCE TO RELATED APPLICATION

This application claims priority to European Application No. 09001777.3, filed 9 Feb. 2009 and entitled "A Covering for an Architectural Opening" and is hereby incorporated by reference as if fully disclosed herein.

FIELD

The invention relates to a covering for an architectural opening. More in particular the invention relates to such coverings having at least one mechanical end stop.

BACKGROUND

Blinds equipped with a mechanical end stop system are known in the art. Best known are the so-called spindle & nut-end stops. A spindle & nut end stop system generally includes a threaded shaft, a wandering nut threaded on the shaft and at least one end stop member fixed on the shaft. For roller blinds and other blinds where a roller is rotated to wind and unwind a covering material about the roller, it generally the case that the nut is keyed to a driven portion of the blind and the shaft is stationary, such that when the blind is driven the nut rotates and is displaced in an axial direction along the threaded nut. When the nut reaches the end stop member the nut can no longer be displaced along the shaft and since the driven portion of the blind is keyed to the nut either directly or by way of the shaft, rotation of the driven blind portion will be stopped too.

When the driven member of a blind rotates with a certain speed the nut will reach the end stop at a considerably speed too. In order dampen the impact of the end stop system it is known to add a shock absorber.

A spindle & nut end stop system with shock absorber is described in U.S. Pat. No. 2,020,595 in relation to a spring driven roller blind. The end stop is set limiting the lifting of the roller blind. A spindle shaft (15) is stationary with respect to the roller (6) about which the blind material is to be wound. A travelling nut (24) is threaded to the shaft (15) and slidably keyed to the roller (6) such that rotation of the roller rotates the nut and it moves along the length of the threaded shaft. When the blind is wound about the roller up to a maximal height the nut impacts the end stop. In order to somewhat cushion an impact impulse, received by the end stop, a compression spring is interposed between a fixed stop and the movable nut.

Another type spindle & nut end stop with impact absorber for a roller blind is described in EP 210381. Here a torsion spring (25) is arranged to the end stop (22), such that the travelling nut (26) will engage the torsion spring directly. The friction between the travelling nut (26) and the torsion spring (25) prevents further rotation of the nut and thus of the blind roller (16).

Both of these systems can only impact the shock in one direction of operation of the blind, in these systems upon lifting of the blind.

Another problem is that springs to absorb the impact in direct contact with the end stop, so that the end stop is displaced by the impact of the travelling nut.

SUMMARY OF THE INVENTION

It is an object of the invention to provide an end stop system with impact absorbing means having improved operational properties. In particular, it is an object of the invention to provide an end stop system with impact cushioning means that are simple yet allowing for bi-directional cushioning. It is a further object of the invention to provide an end stop system with impact cushioning means having at least one end stop at a dedicated position that will not change when impacted.

To this end a covering for an architectural opening is provided comprising:

- a driven member connected to the at least one covering member and able to displace the covering member between an open and a closed position;
- a pair of first and second stationary end stops spaced apart on a stationary member;
- a travelling member movably arranged on the stationary member between the first and second end stops and drivable by the driven member; and
- a single impact absorber flexibly connecting the driven member with the stationary member such that at least a portion of kinematic energy generated by the travelling member interacting with any one of the end stops is cushioned or absorbed.

As a result of providing a single impact absorber a window covering is provided for which end stops can be set for lowering and raising and at each end stop the shock of impact will be absorbed.

Advantageously the impact absorber comprises a first portion and a second portion, said first portion being rotatably arranged with respect to the second portion and being operatively connected thereto by means of an elastic body.

Further advantageously the elastic body is resilient.

According to a further advantageous aspect of the invention the elastic body comprises a torsion spring.

One of the advantageous aspects of the inventions is that the covering can be a roller blind.

These and other aspects of the invention will be discussed in more detail with reference to drawings, wherein like reference numerals refer to like elements. It will be appreciated that the drawings are presents for illustrative purposes and may not be used for limiting the scope of the appended claims.

DETAILED DESCRIPTION OF THE DRAWINGS

Figure 1:
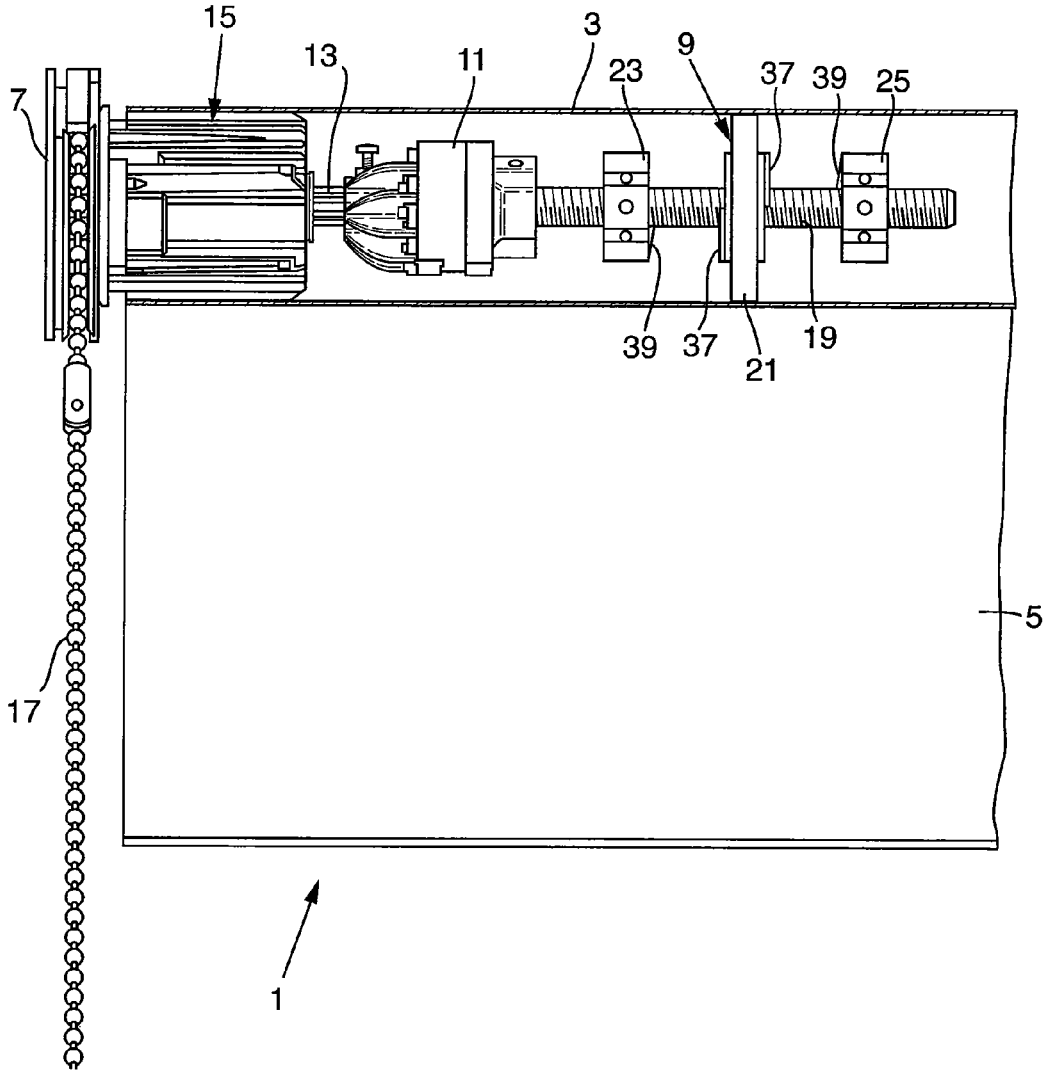
FIG. 1 presents in a schematic way an embodiment of a partial view of a roller blind—with the blind roller in cross section—incorporating the impact absorbing end stop mechanism according to the invention.

FIG. 1 presents in a schematic way an embodiment of a partial view of a roller blind—with the blind roller in cross section—incorporating the impact absorbing end stop mechanism according to the invention.

The roller blind 1 of FIG. one includes a roller 3, a blind member 5, a drive unit 7, a nut & spindle end stop mechanism 9 and an impact absorber 11.

Drive member 7 a stationary i.e. non-rotatable, central journal 13 and a rotatably driven end 15 for engagement with the blind roller 3. Manual drive force is provided by a ball chain loop 17. The drive unit 7 can be any conventional driving clutch mechanism as disclosed in U.S. Pat. No. 6,685,592 or U.S. Pat. No. 7,195,052 and thus does not form part of the present invention. Alternatively the drive unit 7 may also be replaced by a motorized operated drive unit, such as an electric motor drive unit of conventional design.

The nut & spindle end stop mechanism 9 includes a threaded shaft 19, a traveling nut 21 and a pair of left and right end stops 23, 25. The traveling nut 21 is has an inner thread 21A to cooperate with the outer thread 19A of the threaded shaft 19. The end stops 23, 25 are fixable on the shaft at spaced apart locations, such that the end positions of the blind are set; one for the position in which the blind is completely lowered and one for the position when the blind is completely raised.

The impact absorber unit 11 is mounted between the central journal 13 of the drive unit and an end of the threaded shaft 19 of the end stop mechanism 9, such that the journal and the shaft are flexibly, elastically connected. In FIGS. 2-5 it is shown that this connection is realized by a torsion spring 27 having a first and second spring end 29, 31 and the first spring end 29 being held by a first holder 33 and the second spring end 31 being held by a second holder 35. The first and second holders being rotatably one relative the other, and the first spring holder being unrotatably connected to the threaded shaft while the other is unrotatably connected the journal of the drive unit.

The traveling nut 21 is keyed with radially extending formations 21B for engagement with complimentary formation on an inside of the blind roller 7 (not shown but conventional). The drive unit will drive the roller 7 in rotation while the threaded shaft remains stationary. The nut 21 will be driven in rotation in common with the roller 7, the thread of the threaded shaft forces the nut into axial displacement along the roller until it hits one of the end stops 23, 25. The rotational force or torque of the nut 21 will be lead to the threaded shaft 21 and to first spring holder 33 and to the spring 27. The spring will than tighten or loosen, depending on the direction of rotation, and as such absorb the rotational moment of the roller. Thus the flexible connection allows the shaft to rotate slightly with stationary second spring holder 35 and the journal 13.

Due to the fact that the elastic body is allowed to experience torsion in operation pursuant to the relative rotation of the parts of the impact absorber bi-directional impact cushioning is enabled. As a result a simple and reliable bi-directional impact absorber is provided thereby improving an overall performance of the covering 10.

Figure 2:
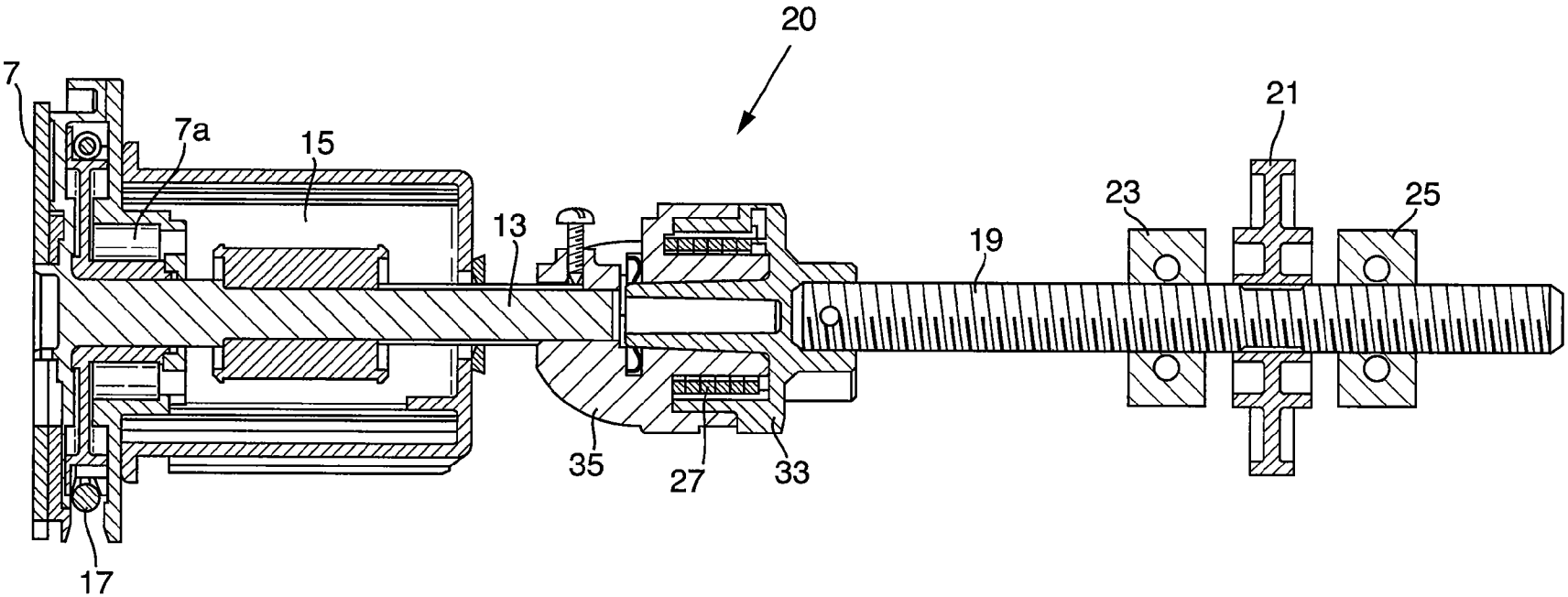
FIG. 2 presents in a schematic way a cross section through a roller blind mechanism and impact absorbing end stop mechanism isolated from the roller blind of FIG. 1.

As best shown in FIG. 2 the second the spring tang 29 of spring 27 is held in an axial slot 33A of the first spring holder 33. The other spring tang 31 is similarly held in a slot 35A in the second spring holder 35. This is best shown in FIG. 4.

Figure 3:
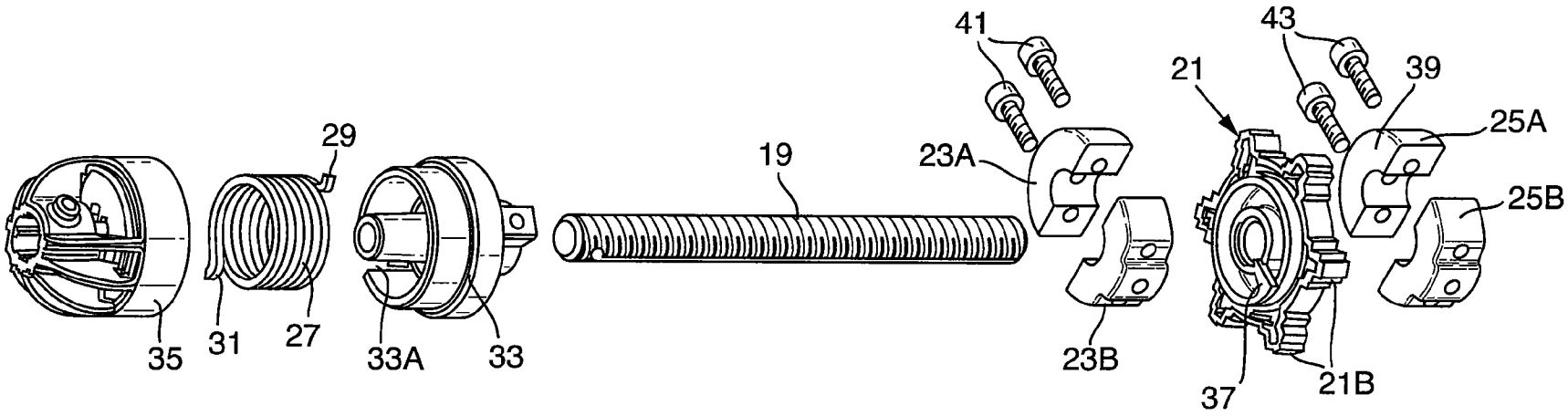
FIG. 3 presents in a schematic way an exploded view of the impact absorbing end stop mechanism of the invention.

FIG. 3 is an exploded view of the impact absorbing and end stop mechanism of the invention.

As shown in FIG. 3 each end stop 23, 25 may comprise two halves 23A, 23B, 25A, 25B which may be affixed to the shaft by means of fixing elements 41, 43, for example, pins. The nut 21 is limited in its travel between the end stops 23, 25 and the mutual positions of the end stops on the shaft 3 may be adjusted in relation to a longitudinal dimension of the architectural opening. The nut 21 has radially projecting flanges 21B to cooperate with inner profiled surface of the blind roller 3. The nut 21 also has a pair of axial flanges 37 projecting on either side of the nut towards the left and right end stops 23, 25. The end stops each have one axial flange 39 on the side projecting towards the nut 21. The axial nut flange 37 and the axial end stop flanges 39, are designed to abut with radial surfaces to positively stop the nut when it reaches one of the end stops.

Figure 4:
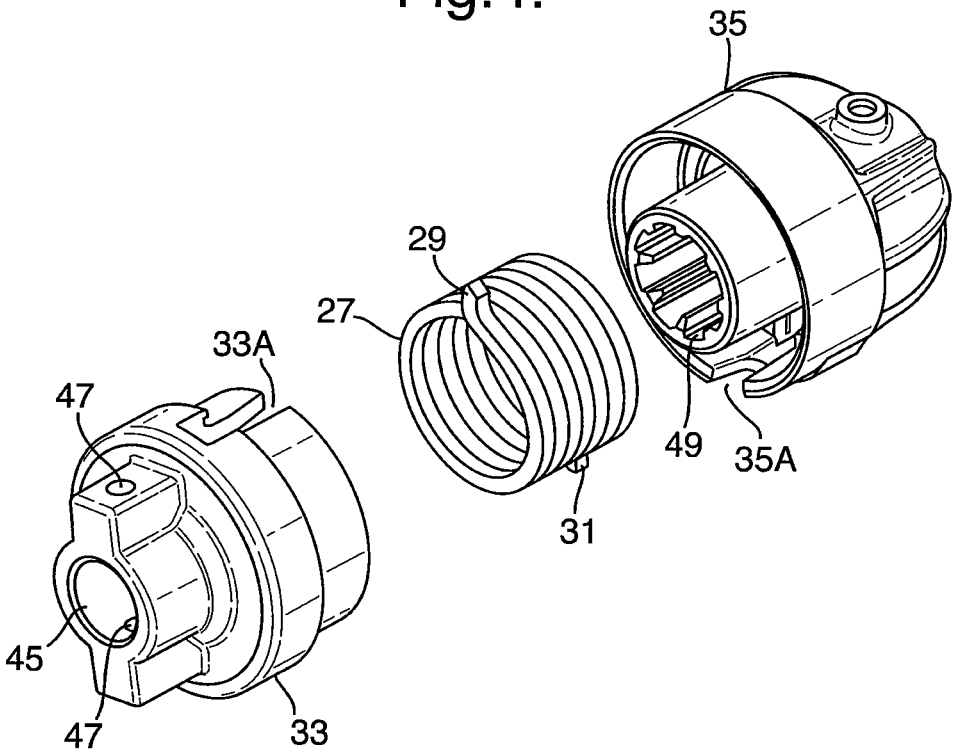
FIG. 4 is an exploded view of the impact absorber of the invention seen in a direction opposite to that in FIG. 3.

FIG. 4 is an exploded view of the impact absorber of the invention seen in a direction opposite to that in FIG. 3. The first spring holder 33 of the impact absorber 11 is conceived to receive threaded shaft 19 via the opening 45. The shaft can be fixed to the first spring holder 33 by aligning a pair of axial openings 47 in the first spring holder with an opening in the shaft, and using a pin or screw projecting through these openings. The second spring holder 35 is provided with an opening 49 to provide a non-rotatable connection to the journal 13 of the drive unit 7.

Figure 5:
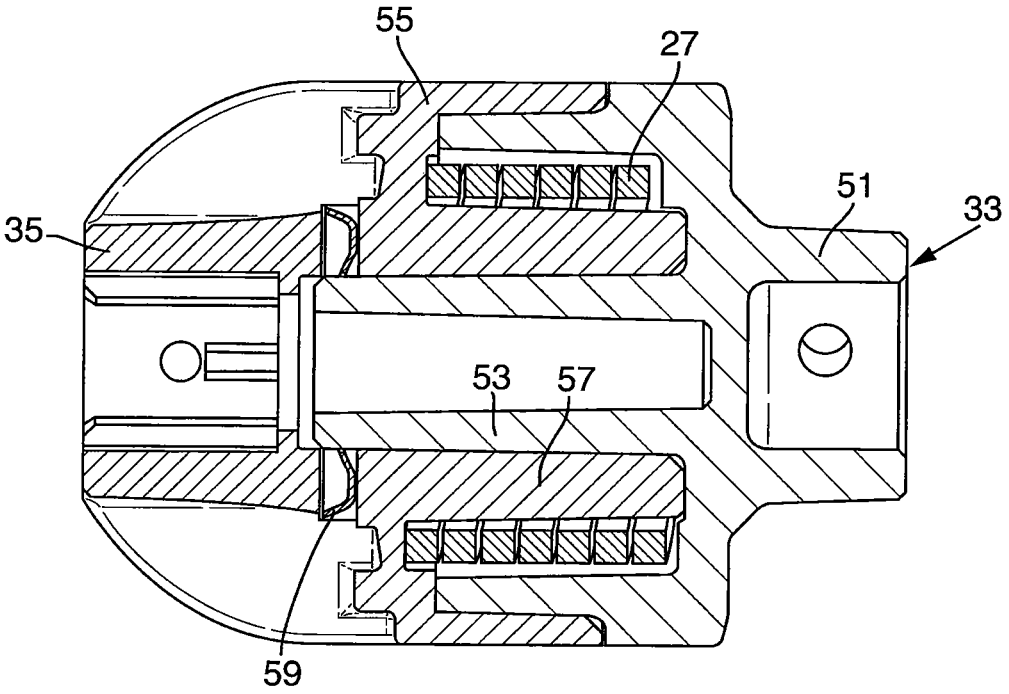
FIG. 5 is an additional elevation in cross section of the impact absorber in assembled condition.

FIG. 5 is an additional elevation in cross section of the impact absorber 11 in assembled condition in the orientation of FIG. 3, which is with the first spring holder 33 shown on the right and the second spring holder 35 shown on the left.

As can be seen in the cross-section the spring 27 is substantially fully enclosed in the impact absorber 11. Also shown is how the first spring holder 33 has an outer tubular body portion 51 that is coaxial with an inner tubular body portion 53. In the same manner the second spring holder 35 has an outer tubular body portion 55 that is coaxial with an inner tubular body portion 57. In assembled condition the inner tubular body portion 53 of the first spring holder is rotatably held within the inner tubular body portion of the second spring holder 35. A circular spring clamp 59 is positioned about the end of the inner tubular body portion 51 of the first spring holder to prevent axial displacement with respect to the second spring holder.

The spring 27 is lies circumferentially on the inner body 57 of the second spring holder 35 while the first and second tangs 29, 31 are held in respective slots 33A, 35A of the first and second spring holders.

It will be appreciated that a material of the spring as well as a number of windings may depend on operational conditions a particular covering is to be used. For example for heavy coverings having a substantial travel an increased number of windings, for example more than ten may be envisaged. In addition the spring may be manufactured from a thicker wire thereby improving wear resistance. However, for light weight coverings having a small travel, the elastic body 27 may comprise a few windings, or it may even be manufactured from a piece of an elastic tube, which can be twisted about its axis in operation.

To the skilled person in this field of the art it will be clear that the invention is not limited to the embodiment represented and described here, but that within the framework of the appended claims variants are possible. To this aspect is will be clear torsion spring 27 can be replace by any flexible and elastic member that allows a certain amount of rotation between the journal 13 and the threaded shaft 19.

Also kinematic inversions are considered inherently disclosed and to be within the scope of the present invention.

This invention is, of course, not limited to the exact details of the above-described embodiments which may be modified without departing from the scope of the claims or sacrificing all of its advantages. In this regard, the terms in the foregoing description and the following claims, such as "right", "left", "front", "rear", "above", "beneath", "vertically", "horizontally", "longitudinally", "upper", "lower", "top" and "bottom", have been used only as relative terms to describe the relationships of the various elements of the roller blinds with or without the spring assist module as described and shown in the figures.

The invention claimed is:

1. A covering for an architectural opening comprising:

a driven member connected to a covering member and able to displace the covering member between an open and a closed position;

a pair of first and second stationary end stops spaced apart on a stationary member;

a traveling member movably arranged on the stationary member between the first and second end stops and drivable by the driven member; and a single impact absorber flexibly connecting the driven member with the stationary member such that at least a portion of kinematic energy generated by the traveling member contacting each of the first and second end stops is cushioned or absorbed, wherein one of the first or second end stops is positioned between the traveling member and the impact absorber such that the traveling member does not contact the impact absorber.

2. A covering according to claim 1, wherein the impact absorber comprises a first portion and a second portion, said first portion being rotatably arranged with respect to the second portion and being operatively connected thereto by an elastic body.

3. A covering according to claim 2, wherein the elastic body is resilient.

4. A covering according to claim 2, wherein the elastic body comprises a torsion spring.

5. A covering according to claim 3, wherein the elastic body comprises a torsion spring.

6. A covering according to claim 1, wherein the covering member comprises at least one sheet of flexible material and adapted to be at least partially wrapped about a blind roller driven by the driven member.

7. The covering of claim 1, wherein when the traveling member contacts the first and second end stops, the traveling member can no longer be displaced along the stationary member.

8. The covering of claim 2, wherein the elastic body is substantially fully enclosed in the impact absorber.

9. A covering for an architectural opening comprising:

a driven member operably connected to a covering and configured to extend and retract the covering;

a threaded shaft operably connected to the driven member;

a first end stop positioned at a first location on the threaded shaft;

a second end stop positioned at a second location on the threaded shaft spaced apart from the first location;

a traveling member movably connected to the threaded shaft between the first end stop and the second end stop and movable along the threaded shaft from the first end stop to the second end stop; and an impact absorber operably connected to the driven member and the threaded shaft; wherein the impact absorber cushions an impact force caused by the traveling member when the traveling member engages the first end stop and when the traveling member engages the second end stop, wherein one of the first or second end stops is positioned between the traveling member and the impact absorber such that the traveling member does not contact the impact absorber.

10. The covering of claim 9, further comprising a drive unit operably connected to the driven member, wherein the impact absorber is operably connected between the drive unit and the threaded shaft.

11. The covering of claim 10, wherein the drive unit comprises a substantially stationary member; and a driven end operably connected to the stationary member and the driven member; wherein the driven end is configured to rotate the driven member in a first direction to extend the covering and rotate the driven member in a second direction to retract the covering; and the impact absorber is operably connected to the stationary member.

12. The covering of claim 11, wherein the impact absorber includes a first spring holder non-rotatably connected to the stationary member;

a second spring holder non-rotatably connected to the threaded shaft and operably connected to the first spring holder; and an elastic body operably connected to the first spring holder and the second spring holder; wherein the first spring holder and the second spring holder are rotatable with respect to each other; and the elastic body experiences torsion due to the rotatable connection between the first spring holder and the second spring holder.

13. The covering of claim 9, wherein the elastic body includes a first tang and a second tang, wherein the first tang operably connects the elastic body to the first spring holder and the second tang operably connects the elastic body to the second spring holder.

14. The covering of claim 9, wherein the traveling member is a nut configured to interact with a thread of the threaded shaft to move between the first end stop and the second end stop.

15. The covering of claim 12, wherein:

the first spring holder includes an inner tubular body portion;

the second spring holder includes an inner tubular body portion; and the inner tubular body portion of the first spring holder is rotatably held within the inner tubular body portion of the second spring holder.

16. The covering of claim 15, wherein the elastic body lies circumferentially on the inner tubular body of the second spring holder.

17. The covering of claim 13, wherein the first and second tangs are received in respective slots of the first and second spring holders.

18. A covering for an architectural opening comprising:

a driven member connected to a covering member;

a drive unit connected to the driven member, the drive unit including:

a substantially stationary member; and a driven end connected to the stationary member and to the driven member, the driven end operable to rotate the driven member in a first direction to extend the covering member and rotate the driven member in a second direction to retract the covering member;

a threaded shaft connected to the driven member;

a first end stop positioned at a first location on the threaded shaft;

a second end stop positioned at a second location on the threaded shaft, the second location spaced apart from the first location;

a traveling member movably connected to the threaded shaft between the first and second end stops, the traveling member movable along the threaded shaft from the first end stop to the second end stop; and an impact absorber operably connected to the driven member, the stationary member, and the threaded shaft and between the drive unit and the threaded shaft such that the impact absorber absorbs an impact force caused by the traveling member contacting the first and second end stops, the impact absorber including:

a first spring holder non-rotatably connected to the stationary member;

a second spring holder non-rotatably connected to the threaded shaft and operably connected to the first spring holder; and a spring operably connected to the first and second spring holders, wherein:

the first and second spring holders are rotatable with respect to each other; and the spring experiences torsion due to the rotatable connection between the first spring holder and the second spring holder.

* * * * *